US005265549A

United States Patent [19]

Cernier

[11] Patent Number: 5,265,549

[45] Date of Patent: Nov. 30, 1993

[54] HYDRO-PROPELLED SHIP

[76] Inventor: Edward J. Cernier, 5400 Braesvalley #65, Houston, Tex. 77096

[21] Appl. No.: 829,447

[22] Filed: Feb. 3, 1992

[51] Int. Cl.[5] ..... B63B 35/00

[52] U.S. Cl. ..... 114/61; 114/8; 114/66; 114/258; 440/38

[58] Field of Search ..... 114/6, 8, 61, 57, 66, 114/261, 274, 258, 270; 440/38, 37

[56] References Cited

U.S. PATENT DOCUMENTS

| | | | |
|---|---|---|---|
| 1,481,469 | 1/1924 | Krammer | 114/8 |
| 2,530,718 | 11/1950 | Napoli | 440/47 |
| 3,163,980 | 1/1965 | Turner | 440/47 |
| 3,531,214 | 9/1970 | Abramson | 440/47 |
| 3,678,689 | 7/1972 | Ishiwata | 440/47 |
| 3,848,558 | 11/1974 | Henry | 114/261 |
| 4,550,673 | 11/1985 | Ingvason | 114/57 |
| 4,838,819 | 6/1989 | Todorovic | 440/47 |
| 4,919,063 | 4/1990 | Hall et al. | 114/61 |
| 4,936,237 | 6/1990 | Walters | 114/61 |

*Primary Examiner*—Michael S. Huppert
*Assistant Examiner*—Thomas J. Brahan
*Attorney, Agent, or Firm*—Michael I. Kroll

[57] ABSTRACT

A hydro-propelled ship is provided which consists of a hull having a double wall, so as to float on a top surface of a body of water. A pair of propulsion turbines are each affixed to a starboard side and a port side of the hull of the ship in a catamaran configuration below the top surface of the body of water. A mechanism is carried within the hull of the ship for generating power to operate each of the propulsion turbines to produce a water jet to propel the ship along the body of water. A pair of adjustable rudders extend downwardly into the body of water from the stern of the hull for steering the ship.

8 Claims, 4 Drawing Sheets

(DOUBLE HULL WITH INTEGRATED TURBINES)

HYDRO-PROPELLED SHIP

BACKGROUND OF THE INVENTION

1. Field of the Invention

The instant invention relates generally to ships and more specifically it relates to a hydropropelled ship.

2. Description of the Prior Art

Numerous ships have been provided in prior art that are adapted to be vessels of considerable size adapted for marine transportation by various types of propulsion. While these units may be suitable for the particular purpose to which they address, they would not be as suitable for the purposes of the present invention as heretofore described.

SUMMARY OF THE INVENTION

A primary object of the present invention is to provide a hydro-propelled ship that will overcome the shortcomings of the prior art devices.

Another object is to provide a hydropropelled ship that utilizes a pair of propulsion turbines affixed to a double hull of the ship in a catamaran configuration to drive the ship.

An additional object is to provide a hydropropelled ship in which a power plant within the hull of the ship will operate the propulsion turbines and also drive two revolving restaurants with helipads thereon.

A further object is to provide a hydropropelled ship that is simple and easy to use.

A still further object is to provide a hydro-propelled ship that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
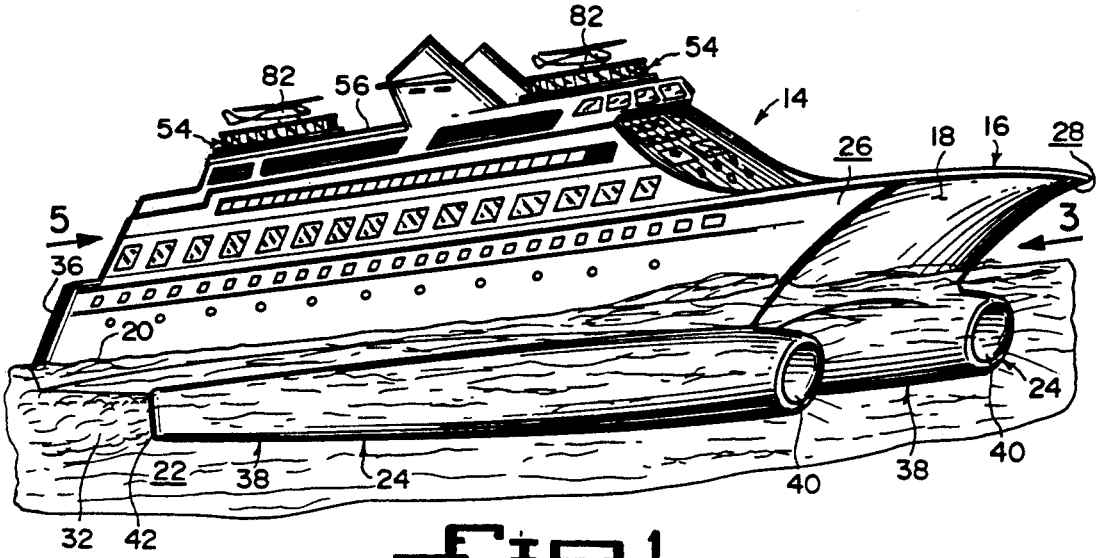
FIG. 1 is a front perspective view of the instant invention.

Turning now descriptively to the drawings, in which similar reference characters denote similar elements throughout the several views, the Figures illustrate a hydro-propelled ship 14 which consists of a hull 16 having a double wall 18, so as to float on a top surface 20 of a body of water 22. A pair of propulsion turbines 24 are each affixed to a starboard side 26 and a port side 28 of the hull 16 of the ship 14 in a catamaran configuration below the top surface 20 of the body of water 22. A mechanism 30 is carried within the hull 16 of the ship 14 for generating power to operate each of the propulsion turbines 24 to produce a water jet 32 to propel the ship 14 along the body of water 22. A pair of adjustable rudders 34 extend downwardly into the body of water 22 from the stern 36 of the hull 16 for steering the ship 14.

Each propulsion turbine 24 includes an elongated tubular housing 38 having a water intake port 40 and a water exit port 42. A shaft 44 runs through the center of the housing 38 and is operable by the power generating mechanism 30. A plurality of rotors 46 are attached in spaced apart relationships to the shaft 44. When the shaft 46 rotates the rotors 46 will squeeze, compress and force water entering the water intake port 40 through the water exit port 44 to produce the water jet 32.

Each rotor 46 includes a plurality of fan blades 48 radially extending at an angle about the shaft 44.

Figure 8:
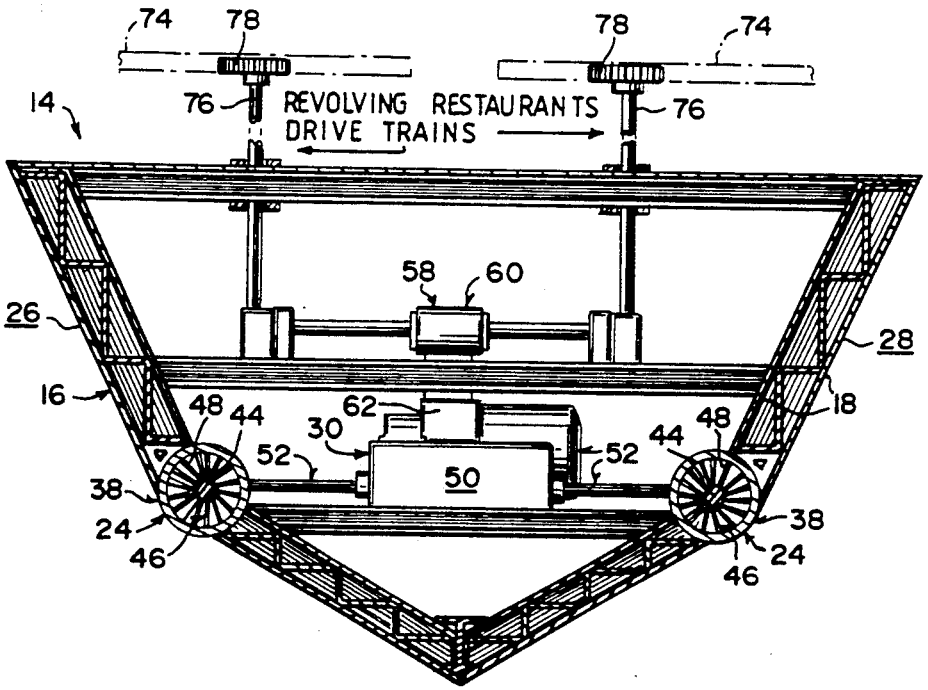
FIG. 8 is a diagrammatic cross sectional view taken through the hull showing a power plant for generating power to each of the propulsion turbines and a drive train assembly for rotating two restaurant structures carried on a top deck of the hull.
Figure 9:
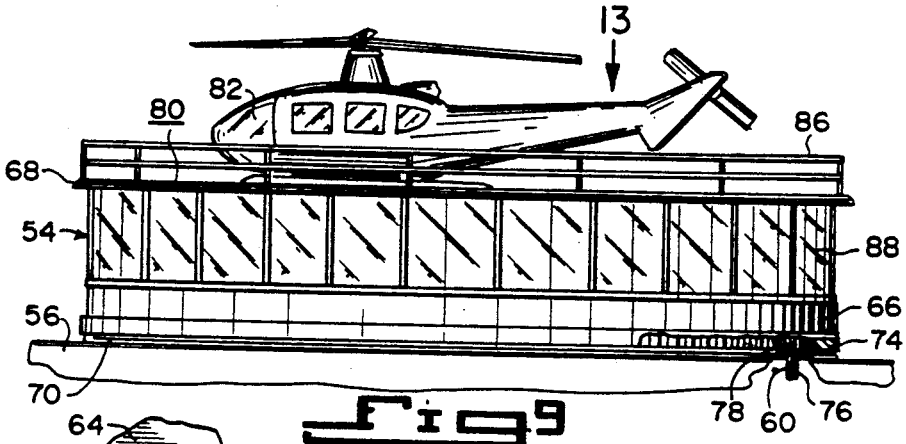
FIG. 9 is an elevational view with parts broken away of one of the restaurant structures.
Figure 11:
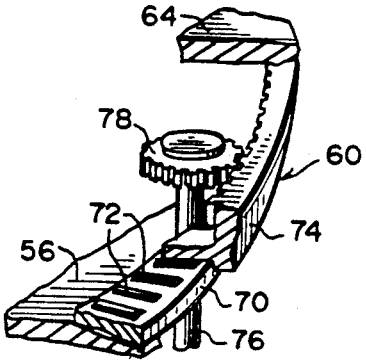
FIG. 11 is a perspective view with parts broken away and in section of an upper portion of the drive train assembly for rotating one of the restaurant structures.

The power generating mechanism 30, shown in FIG. 8, is a power plant 50 which contains a complex of structures, machinery and associated equipment 52 for generating power therefrom.

The concept of the propulsion turbines 24 calls for the use of a 25,000 HP engine to enable each of the propulsion turbines 24 to suck in seawater and force it out. This can make the hydropropelled ship 14 advance in the body of water 22 to a speed up to fifty knots or more.

A pair of restaurant structures 54 are carried on a top deck 56 of the hull 16. An apparatus 58 extends from the power plant 50, for rotating the restaurant structures 54 on the top deck 56 of the hull 16, in which the rotating apparatus 58 is a drive train assembly 60. A clutch 62 is between the power plant 50 and the drive train assembly 60, so that the clutch 62 can engage and disengage the drive train assembly 60.

Each restaurant structure 54 includes a circular floor slab 64. A cylindrical exterior wall 66 extends upwardly from the circular floor slab 64, while a circular roof 68 is on top of the cylindrical exterior wall 66.

The drive train assembly 60 includes a large annular plate 70 having a plurality of roller bearings 72 thereabout. The annular plate 70 is carried on the top deck 56 of the hull 16. A large internal spur gear 74 is rotatably carried on the annular plate 70, whereby the internal spur gear 74 supports the circular floor slab 64 of the restaurant structure 54 thereon. A drive shaft 76 extends through the top deck 56 of the hull 16. A spur pinion gear 78 affixed to a distal end of the drive shaft 76, to make internal contact with the internal spur gear 74 to rotate the restaurant structure 54 thereabout.

The circular roof 68 of each restaurant structure 54 includes a helipad 80 for a helicopter 82 to land and take off. The helipad 80 includes a stairwell 84 extending downwards into the interior of the restaurant structure 54. A railing 86 extends about the circumference of the helipad 80.

Figure 10:
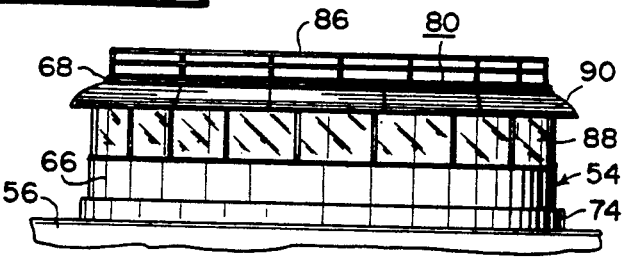
FIG. 10 is an elevational view of one of the restaurant structures with a continuous awning thereabout.
Figure 12:
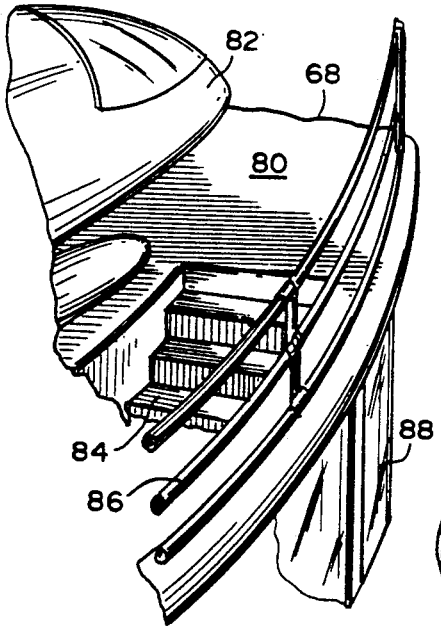
FIG. 12 is a perspective view with parts broken away of an upper portion of one of the restaurant structures showing a helipad, stairwell and railing in greater detail.
Figure 13:
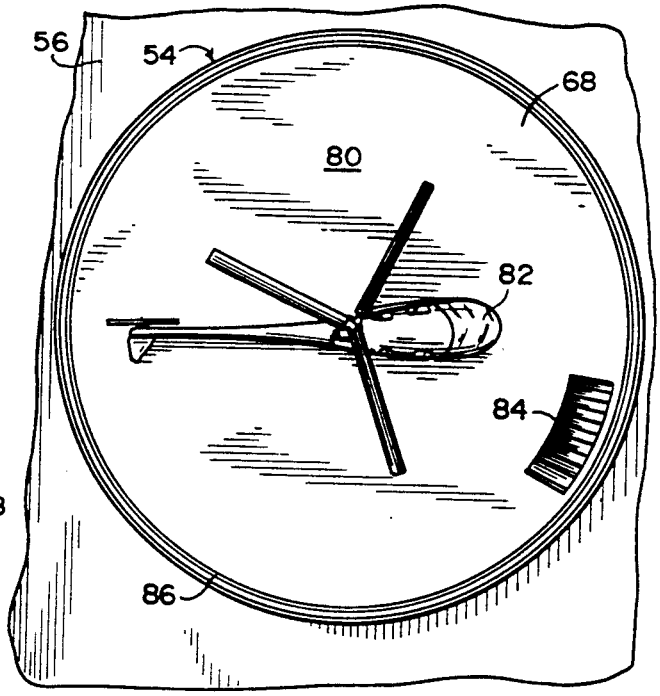
FIG. 13 is a top view taken in direction of arrow 13 in FIG. 9 showing the helipad on the roof of the restaurant structure.

Each restaurant structure 54 further includes a plurality of continuous windows 88 about the cylindrical exterior wall 66, so that people within each restaurant structure 54 can look through the windows 88 and see the view therefrom, especially when each restaurant structure 54 rotates. Each restaurant structure 54 can also contain a continuous awning 90 affixed to the cylindrical exterior wall 66 above the windows 88 to shade the windows 88 from direct sunlight (see FIG. 10).

Figure 2:
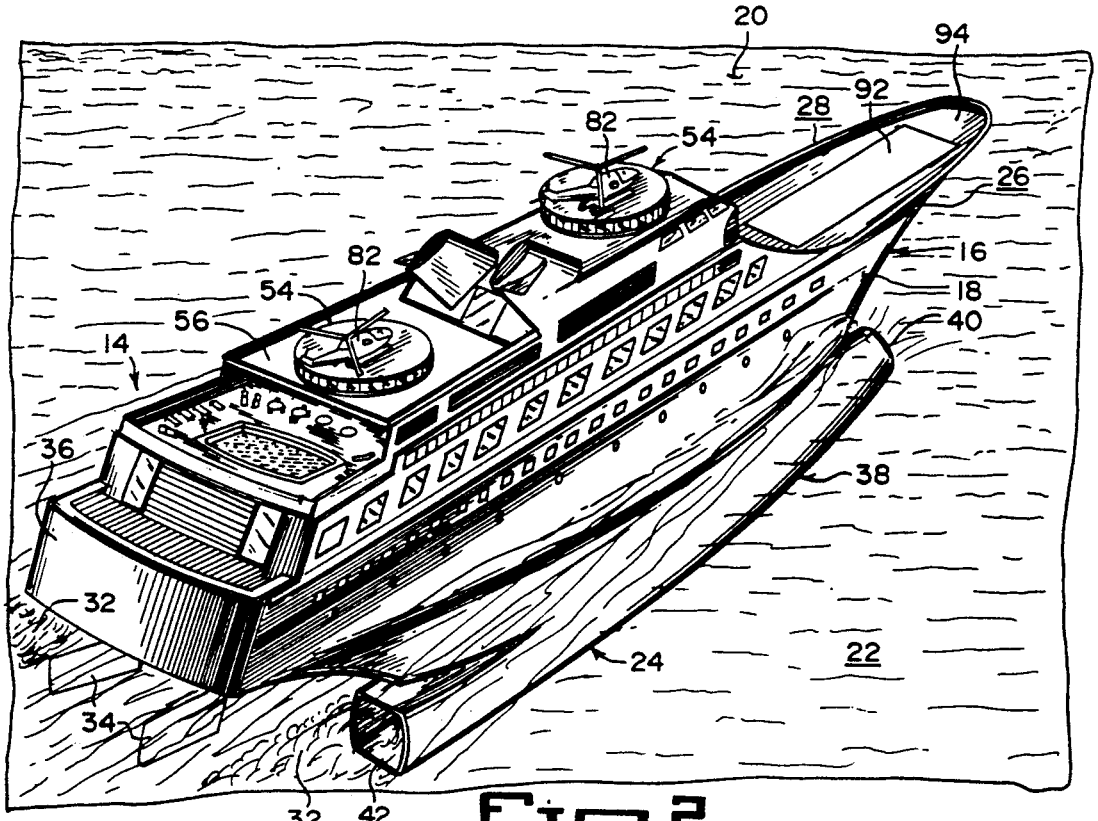
FIG. 2 is a rear perspective view of the instant invention.
Figure 3:
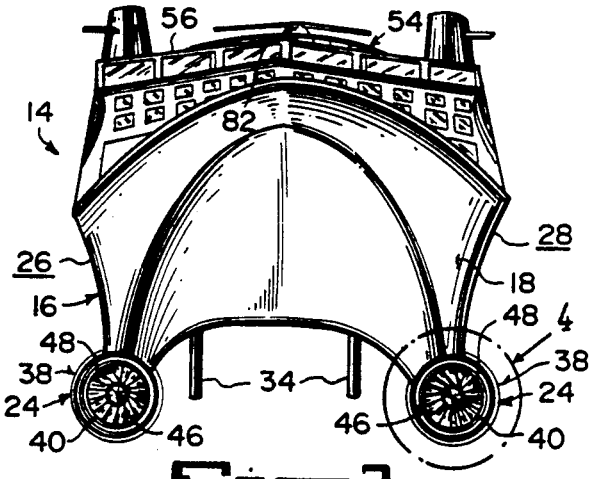
FIG. 3 is a front view taken in direction of arrow 3 in FIG. 1.
Figure 4:
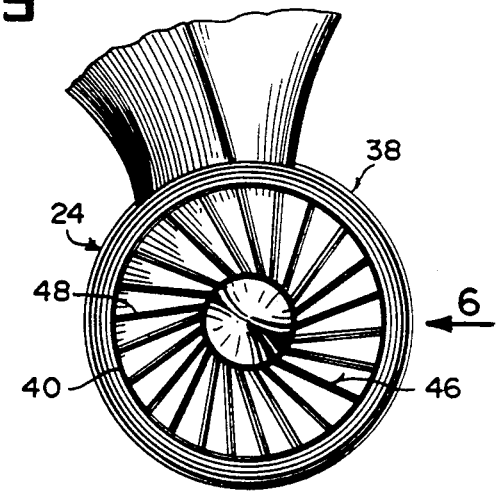
FIG. 4 is an enlarged view as indicated by arrow 4 in FIG. 3 showing the front of one of the propulsion turbines in greater detail.
Figure 5:
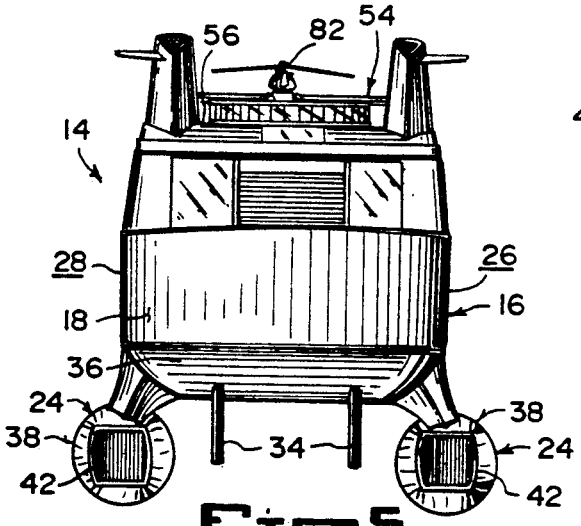
FIG. 5 is a rear view taken in direction of arrow 5 in FIG. 1.
Figure 6:
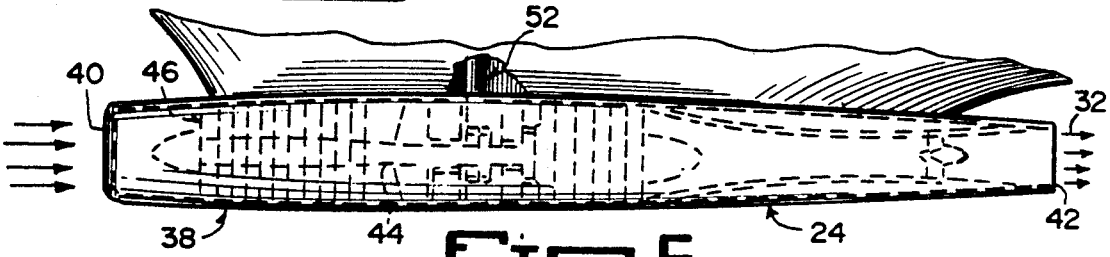
FIG. 6 is a side view of one of the propulsion turbines as indicated by arrow 6 in FIG. 4.
Figure 7:
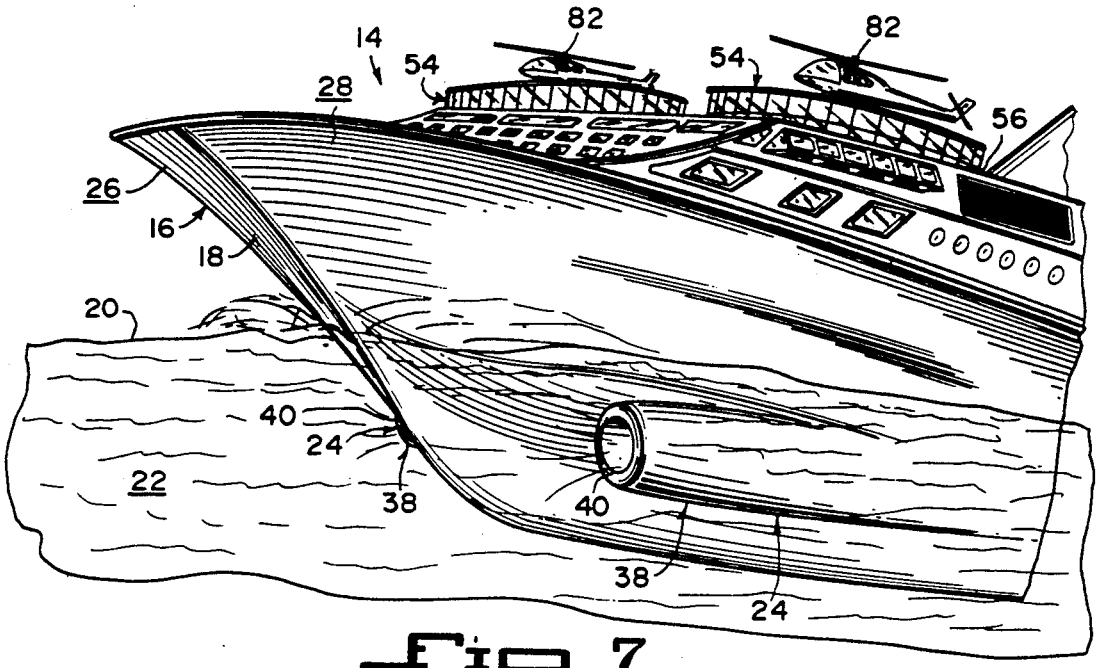
FIG. 7 is an enlarged perspective view of a front bow portion of the instant invention.

An ice skating rink 92 can also be provided on a lower deck 94 of the hull 16, as shown in FIG. 2, for the pleasure and use of the passengers on the hydro-propelled ship 14.

LIST OF REFERENCE NUMBERS 14 hydro-propelled ship
16 hull on 14
18 double wall in 16
20 top surface
22 body of water
24 propulsion turbine
26 starboard side of 16
28 port side of 16
30 power generating mechanism
32 water jet
34 adjustable rubber
36 stern of 16
38 elongated tubular housing
40 water intake port on 38
42 water exit port on 38
44 center shaft in 38
46 rotor on 44
48 fan blade in 46
50 power plant for 30
52 complex of structures, machinery and associated equipment in 50
54 restaurant structure
56 top deck of 16
58 rotating apparatus
60 drive train assembly for 58
62 clutch
64 circular floor slab in 54
66 cylindrical exterior wall in 54
68 circular roof in 54
70 large annular plate
72 roller bearing in 70
74 large internal spur gear
76 drive shaft
78 spur pinion gear on 76
80 helipad on 68
82 helicopter
84 stairwell in 80
86 railing on 80
88 window in 66
90 awning on 66
92 ice skating rink
94 lower deck of 16

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the ar without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hydro-propelled ship which comprises:

a) a hull having a double wall, so as to float on a top surface of a body of water;

b) a pair of propulsion turbines, one turbine is affixed to the starboard side and the other is affixed to the port side of said hull of said ship in a catamaran configuration below the top surface of the body of water, each of said propulsion turbines includes an elongated tubular housing having a water intake port and a water exit port, a shaft running through the center of said housing and operable by said power generating means, and a plurality of rotors attached in spaced apart relationships to said shaft, so that when said shaft rotates said rotors will squeeze, compress and force water entering the water intake port through the water exit port to produce the water jet, each said rotor includes a plurality of fan blades radially extending at an angle about said shaft;

c) means carried within said hull of said ship, for generating power to operate each of said propulsion turbines to produce a water jet to propel said ship along the body of water, said power generating means is a power plant, said power plant includes associated equipment for generating power therefrom, further including a restaurant structure carried on a top deck of said hull, and means extending from said power plant, for rotating said restaurant structure on the top deck of said hull, said rotating means is a drive train assembly;

d) a pair of adjustable rudders extending downwardly into the body of water from the stern of said hull for steering said ship.

2. A hydro-propelled ship as recited in claim 1, further including a clutch between said power plant and said drive train assembly, so that said clutch can engage and disengage said drive train assembly.

3. A hydro-propelled ship as recited in claim 2, wherein said restaurant structure includes:

a) a circular floor slab;

b) a cylindrical exterior wall extending upwardly from said circular floor slab; an c) a circular roof on top of said cylindrical exterior wall.

4. A hydro-propelled ship as recited in claim 3, wherein said drive train assembly includes:

a) a large annular plate having a plurality of roller bearings thereabout, said annular plate carried on the top deck of said hull;

b) a large internal spur gear rotatably carried on said annular plate, whereby said internal spur gear supports said circular floor slab of said restaurant structure thereon;

c) a drive shaft extending through the top deck of said hull; and d) a spur pinion gear affixed to a distal end of said drive shaft, to make internal contact with said internal spur gear to rotate said restaurant structure thereabout.

5. A hydro-propelled ship as recited in claim 4, wherein said circular roof of said restaurant structure includes a helipad for a helicopter to land and take off.

6. A hydro-propelled ship as recited in claim 5, wherein said helipad includes:

a) a stairwell extending downwards into the interior of said restaurant structure; and b) a railing extending about the circumference of said helipad.

7. A hydro-propelled ship as recited in claim 6, wherein said restaurant structure further includes a plurality of continuous windows about said cylindrical exterior wall, so that people within said restaurant structure can look through said windows and see the view therefrom.

8. A hydro-propelled ship as recited in claim 7, wherein said restaurant structure further includes a continuous awning affixed to said cylindrical exterior wall above said windows to shade said windows from direct sunlight.

* * * * *